US006625951B1

(12) United States Patent
McCarthy

(10) Patent No.: US 6,625,951 B1
(45) Date of Patent: Sep. 30, 2003

(54) FLOOR LAYING AND LEVELING SYSTEM

(76) Inventor: Lawrence McCarthy, 301 Cloverdale Blvd., Ft. Walton Beach, FL (US) 32547

( * ) Notice: Subject to any disclaimer, the term of this patent is extended or adjusted under 35 U.S.C. 154(b) by 0 days.

(21) Appl. No.: 10/006,422

(22) Filed: Dec. 10, 2001

(51) Int. Cl.[7] ..... E04G 21/10

(52) U.S. Cl. ..... 52/747.1; 52/127.2; 52/387; 52/391; 52/749.11; 52/749.13; 52/DIG. 1; 33/404; 33/527; 33/518; 33/DIG. 20; 156/297; 156/304.3

(58) Field of Search ..... 52/747.1, 747.11, 52/747.12, 749.1, 749.11, 749.13, 127.2, 387, 391, 392, 687, DIG. 1; 33/404, 526, 527, 518, DIG. 20; 156/63, 91, 297, 304.1, 304.3

(56) References Cited

U.S. PATENT DOCUMENTS 1,836,964 A * 12/1931 Grigsby et al.
3,010,213 A * 11/1961 Rodtz, Sr.
3,295,281 A * 1/1967 Dixon
3,861,098 A * 1/1975 Schaub ..... 52/98
4,503,654 A * 3/1985 Cosentino ..... 52/747
4,835,924 A * 6/1989 Blackin et al. ..... 52/263
4,953,341 A * 9/1990 Joos ..... 52/747
5,201,130 A * 4/1993 Krchnak ..... 33/526
5,288,534 A * 2/1994 Tavshanjian ..... 428/64
5,359,783 A * 11/1994 Smith ..... 33/527
5,418,036 A * 5/1995 Tokikawa et al. ..... 428/120
5,607,256 A 3/1997 McCleary
5,623,799 A * 4/1997 Kowaslski et al. ..... 52/392
5,832,619 A 11/1998 Volkema, Jr.
6,000,184 A 12/1999 Fernandes

* cited by examiner

*Primary Examiner*—Carl D. Friedman
*Assistant Examiner*—Yvonne M. Horton
(74) *Attorney, Agent, or Firm*—William B. Noll

(57) ABSTRACT

A system for laying and leveling a tile walking surface, i.e. indoor floor or outdoor patio or pathway, where the system relies upon the use of inserts embedded within the adhesive for securing the tile. A preferred insert is a single plastic member, preferably circular in configuration, and contains plural through openings for receiving and securing the insert into the adhesive. Optionally, removable space dividers may be provided where the space dividers are initially positioned in the openings for spacing adjacent tiles, then removed to allow grouting of the spaces. Alternately, the insert may be a two-piece member that can be vertically adjusted where needed to ensure a level substrate and hence a level walking surface.

9 Claims, 6 Drawing Sheets

FLOOR LAYING AND LEVELING SYSTEM

FIELD OF THE INVENTION

This invention is directed to the field of laying and leveling a tile floor, both indoors and outside, more particularly to system for laying and leveling generally rectangular-like flooring tiles that incorporates a series of leveling inserts embedded within the flooring adhesive. The inserts are embedded at locations to underlie the respective corners of the tiles.

BACKGROUND OF THE INVENTION

The present invention relates to a unique system for laying and leveling a tile-like floor, especially heavy tiles such as precast or marble tiles whose weight can effect the laying and ultimate leveling of such tiles. A broad molded insert is positioned within the tile adhesive, whether a cement mix for outdoors or polyermeric adhesive for indoor floors, at the respective corners or joints for adjacent tiles.

Both professionals and do-it-yourselfers who wish to place or replace a tile floor, whether indoor or out doors, can be a difficult task as the underlying floor or substrate often is not flat. As a consequence, much preliminary effort is required to prepare the site for the laying of a tile floor. The prior art recognized some of the difficulties in this task, where the prior art is reflected in the following U.S. Patents:

a.) U.S. Pat. No. 6,000,184, to Fernandes, teaches a tile floor installing system that includes the installation of tiled coverings on unprepared underlying substrates. The base has two substantially parallel surfaces, openings to permit the introduction of mortar between the base and the underlying substrate, fastening points for the use of mechanical fasteners to attach the base to the underlying substrate, and fixed or adjustable spacers to keep the base in proper alignment with the underlying substrate. One or more curved edges may be added to accommodate curved-edged tiled coverings, interlocking segments may be added to provide additional lateral support and a ledge may be added to assist in supporting the tiled coverings or for leveling purposes. Mortar may be introduced into the space between the lower surface of the base and the underlying substrate through openings in the base and the tiled coverings are attached to the mortar presented at the openings. Alternatively, the tiled coverings may be attached to the base using a mastic or adhesive and the installation accomplished without mortar.

b.) U.S. Pat. No. 5,832,619, to Volkema, Jr. relates an adjustable frame for simultaneously aligning and installing multiple tiles on a floor. The adjustable frame contains a plurality of tile apertures. Each tile aperture is sized to accept a particular tile size. Tiles are inserted into each of the tile apertures to allow multiple tiles to be installed and automatically be aligned with one another during the installation process. The width of the grout area between the tiles is thus automatically set by the width of the adjustable frame segments. The adjustable frame is fabricated from independent frame segments which have internal adjustment rod channels. Adjustment rods are adjustably secured to two frame segments such that the distance between the frame segments can be selectably varied. By varying the distance between frame segments, the size of the tile aperture is varied, and therefore the tile size can be varied. The size of the tile apertures can be independently varied in a lateral direction or in a longitudinal direction. Frame segments are independently adjustable such that multiple tile sizes can be installed simultaneously. Tiles with a square or rectangular shape can be installed simultaneously.

c.) U.S. Pat. No. 5,607,256, to McCleary, discloses an adjustable, floor tile mortar and grout spreading device for applying bonding material at a predermined thickness in an efficient manner, and for spreading grout between floor tiles. The device comprises a telescopically adjustable rectangular frame having a leading edge and a trailing edge and a pair of downwardly extending sides for containing bonding material. The rectangular frame is telescopically adjustable to various widths and can be fixed at a particular width depending upon the size tile for the given installation. In one embodiment, the trailing edge incorporates a downwardly extending trowel blade having a conventional trowel blade edge with either a saw-tooth or square-toothed shape. The trowel blade is adjustable such that the device may be used for spreading various thicknesses of bonding material. Bonding material is poured onto the subfloor between the frame leading edge and trailing edge is spread by sliding the device across the sub-floor such that the trailing edge trowel spreads the bonding material uniformly. In the grout spreading configuration, the trowel blade is replaced by a first grout float and a second grout float acting as a squeegee is attached at the trailing end for spreading grout into the gaps existing between individual tiles.

While such efforts as found in the foregoing patents offer some assistance in laying a tiled floor, none offer the simplicity of laying and leveling a tile floor, particularly a heavy tile flooring material, such as precast concrete and marble tiles. The manner by which the present invention meets the goals of this invention will become apparent in the following description, particularly when read in conjunction with the accompanying drawings.

SUMMARY OF THE INVENTION

This invention is directed to a system for laying and leveling a tile floor, preferably rectangular or square tiles for indoors or outdoors applications, that is being placed on a subfloor or ground base. A typical first step is the application of an adhesive, such as a cement compound or polymeric substance, then leveled by spreading with a trowel or related implement. Thereafter, tile positions may be aligned by a grid to precisely define the location of the respective tiles. At joint or corner locations molded plastic inserts, having planar upper and lower surfaces, are positioned, where said inserts are preferably circular in configuration, though other shapes may be used, for internal joints, having plural radial vanes, each containing a series of through openings. For edge and corner applications, the inserts may preferrably comprise a semi-circular or quarter-circular members. In all cases, the series of openings allow the adhesive to ooze into and secure said inserts while providing a level surface and of a size to receive the overlying tiles. Especially with heavy tiles, such as precast concrete or marble, it is critical to provide a broad surface to avoid uneven placement of the tiles. In those applications where it may be desirable to space adjacent tiles from one another, where the spacing is ultimately filled with a grouting material, a plastic divider is provided. The divider, which may vary in configuration depending on the particular joint in question, i.e. two, three or four tiles, includes at least a pair of vertical walls, where the lower edges are provided with one or more tapered projections which cooperate with the openings to temporarily space adjacent tiles from one another.

A modified, vertically adjustable insert is contemplated where it may be desirable to provide vertical adjustment for the system. The modified insert may comprise a pair of disk-like components that are rotatable relative to one another, where the mating surfaces act as camming surfaces to raise or lower the disk assembly when rotated from 0° to 180°.

Accordingly, an object of this invention is to provide an effective system for laying and leveling a tile floor, for indoor and outdoor applications, where the system is especially suited for heavy precast or marble tiles.

Another object hereof is the provision of a seating insert to ensure a level tile floor.

A further object lies in the use of an insert having a planar upper surface and a series of radial vanes, where each said vane includes a series of through openings to allow the underlying adhesive to ooze into said openings to anchor the vanes and provide a level surface for receiving the overlying tiles.

These and other objects of the invention will become apparent in the description which follows, particularly when read in conjunction with the accompanying drawings.

DETAILED DESCRIPTION OF PREFERRED EMBODIMENT

Figure 1:
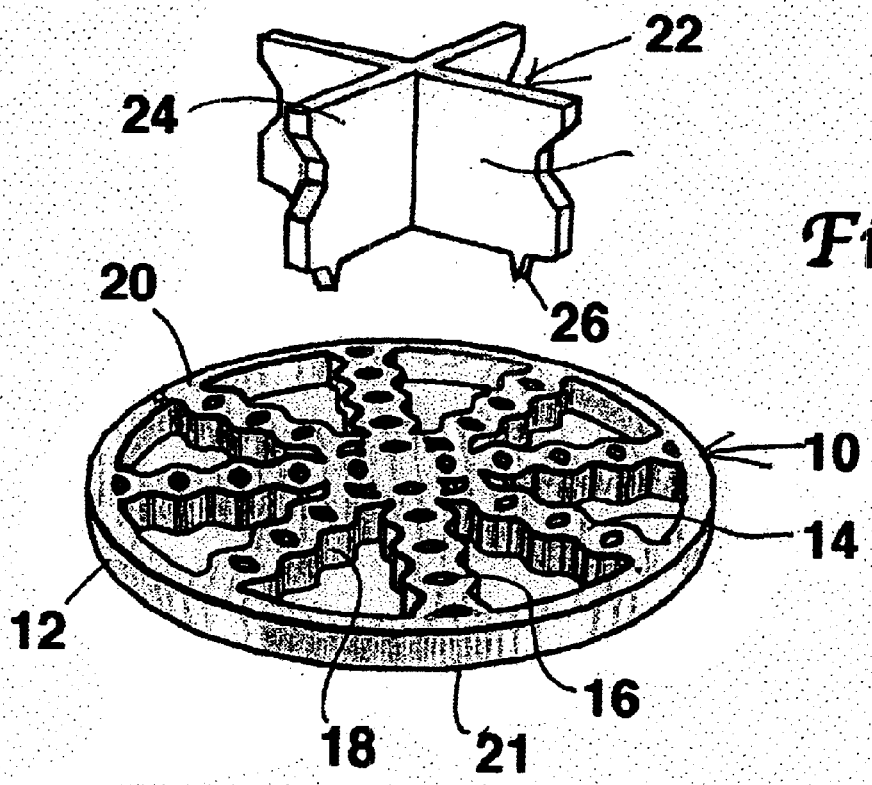
FIG. 1 is an exploded perspective view of a preferred leveling insert for use at the junction of four, overlying rectangular tiles according to the floor laying and leveling system of this invention, plus a removable X-shaped grout divider for removably attachment to said insert.

This invention relates to a system for laying and leveling a tile floor, whether indoors or outdoors, by the use of a pedestal-like insert, embedded within the underlying tile adhesive, upon which the tile seats. The invention will now be described with regard to the ten Figures, where like reference numerals represent like components or features throughout the various views.

Figure 2:
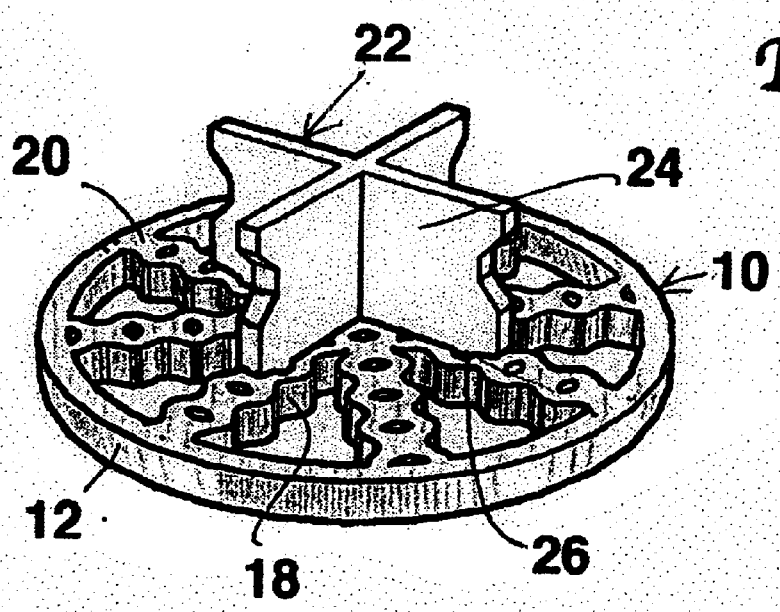
FIG. 2 is a perspective view of the assembly of FIG. 1.
Figure 11:
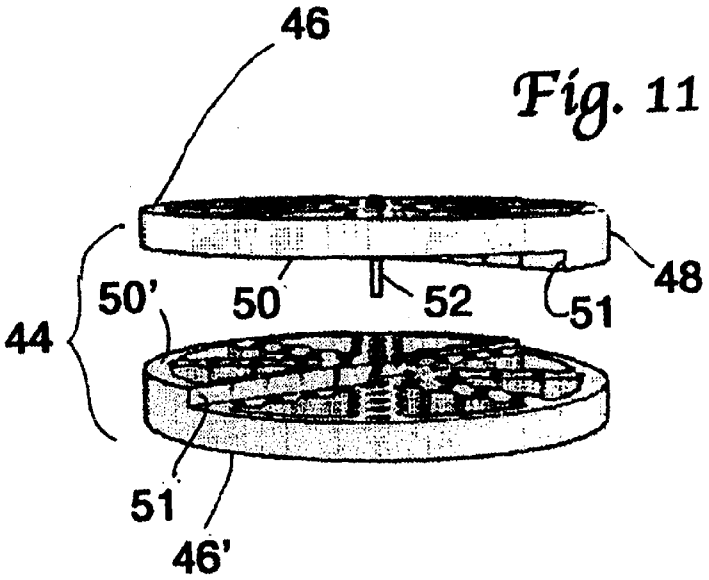
FIG. 11 is an exploded perspective view for a two-piece, modified insert for use in the tile laying and leveling system of this invention.
Figure 3:
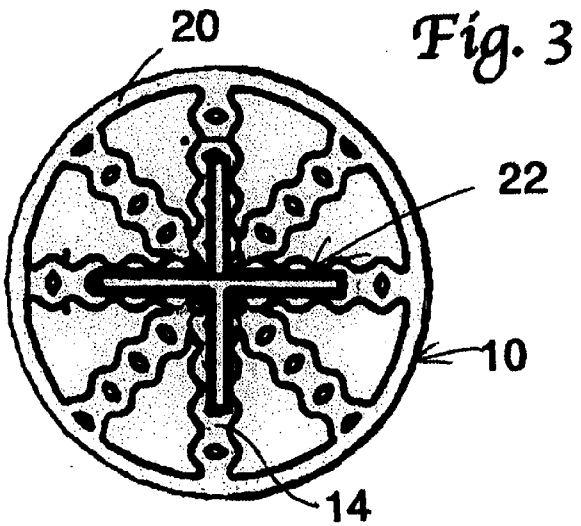
FIG. 3 is a top view of the assembly of FIG. 2.

FIGS. 1 and 2 illustrate a preferred insert 10 for laying and leveling a floor according to this invention, where the insert, especially for internal portions of a floor where four tiles are positioned adjacent to one another, is characterized by a generally circular body 12, preferably molded of plastic, such as PVC, having upper and lower planar surfaces and plural radial vanes 14, each containing a series of openings 16. Further, the vanes are characterized by a wavy profile to extend the surface area of the side 18, a feature that is important to firmly secure the insert within the underlying adhesive, as known in the art for laying tile, where the adhesive may be a cement mix for outdoor applications or a polymeric substance for indoor applications. A final feature of the insert is an upper surface 20 that is planar for reasons to become apparent hereafter, and preferably parallel to the lower surface 21. While the circular shape is preferred, other shapes may be applicable so long as there is a planar upper surface and sufficient surface area to engage and be secured by the underlying adhesive.

A further feature of the various openings 16 is illustrated in FIGS. 1 and 2. Often in laying tile one desires to provide a space between adjacent tiles, where the space is to be filled with grout, cement, etc. as known in the art. To provide the spacing, a space divider 22 may be provided, where said divider, in this preferred embodiment is X-shaped. The space divider comprises a pair of intersecting, vertical walls 24 of a height greater than the tile thickness, where the lower edges are provided with plural tapered projections 26 for removably securing the divider 22 into appropriate said openings 16. With the divider so positioned as in FIG. 2, the tiles may be laid to abut the walls 24. Thereafter, the dividers may be easily removed to expose a uniform spacing between adjacent tiles for grouting.

Figure 7:
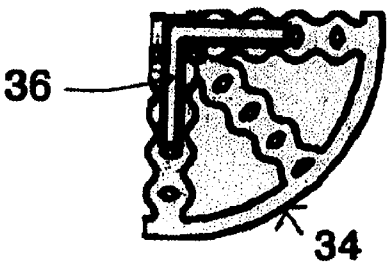
FIG. 7 is a top view of the assembly of FIG. 6.
Figure 5:
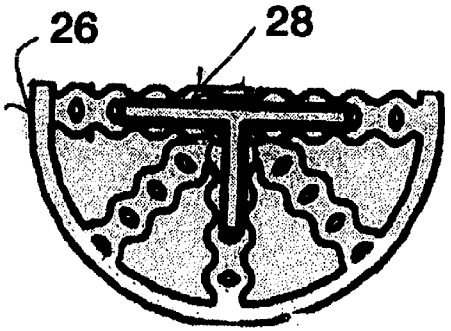
FIG. 5 is a top view of the assembly of FIG. 4.
Figure 6:
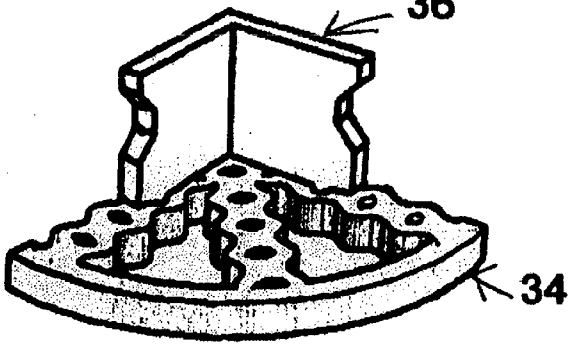
FIG. 6 is a perspective view of a "quarter" insert and L-shaped grout divider for underlying an outside corner for a tile to be leveled.
Figure 4:
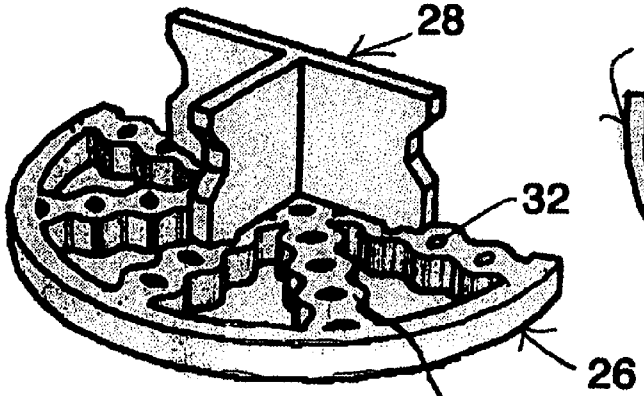
FIG. 4 is a perspective view of a "half" insert and T-shaped grout divider for underlying a pair of tiles according to this invention.

It should be understood that floors or outdoor patios to be laid are not infinite in size, but rather feature inside and outside corners and edges. Accordingly, it is necessary to provide an insert that can be used along straight edges and corners, see FIGS. 4–7. FIGS. 4 and 5 illustrate a "half" circle insert 26 and T-shaped space divider 28 that may be used along a straight edge, for example. Even with this embodiment, the insert 26 is characterized by plural radial vanes 30 and openings 32, as discussed above. FIGS. 6 and 7, on the other hand, illustrate a "quarter" insert 34 and complementary L-shaped divider 36 for use on laying outside corners of tiles.

Figure 8:
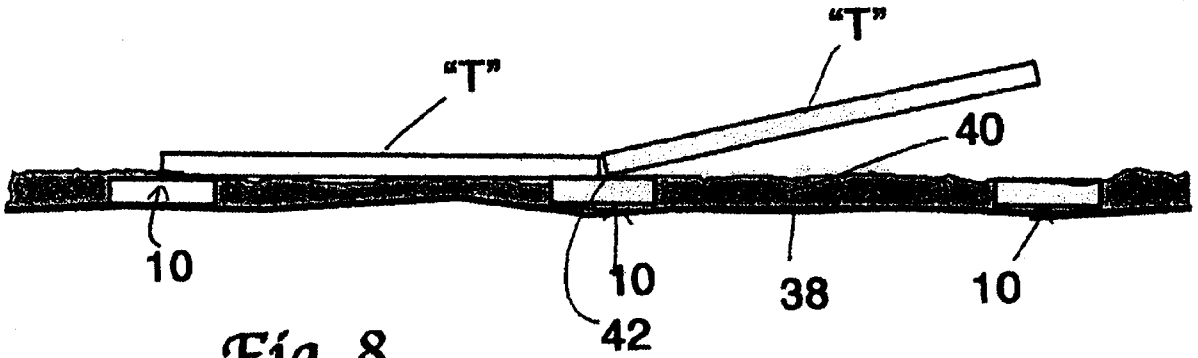
FIG. 8 is a sectional view of the system hereof, where several said inserts are shown embedded in an adhesive over a subfloor or ground, with a first layed tile and leveled and a second tile in the process of laying and leveling.

FIG. 8 is a sectional view of a tile laying operation, where the underlying substrate 38, often uneven, has been primed by the application of a layer 40 of tile adhesive, as known in the art, where the layer of adhesive is essentially of a depth at least equal to the depth of the insert 10. In other words, the insert is embedded within the adhesive layer, where the adhesive oozes through the openings 16 and along the extended vane sidewalls to fix the inserts for eventual laying of the tiles "T". FIG. 8 further illustrates one of the difficulties of laying particularly heavy tiles, such as precast concrete and marble tiles. The Figure shows a laid and leveled tile "T", with a second tile positioned to lie adjacent the first tile. With heavy tiles, one of the problems encountered is that the weight of the tile, such as at the initial contact corner 42, can press down into the adhesive making it very difficult to obtain a level floor. However, by the use of the inserts of this invention, it is possible to conveniently lay and level a floor, particularly where such floor is composed of heavy tiles.

Figure 9:
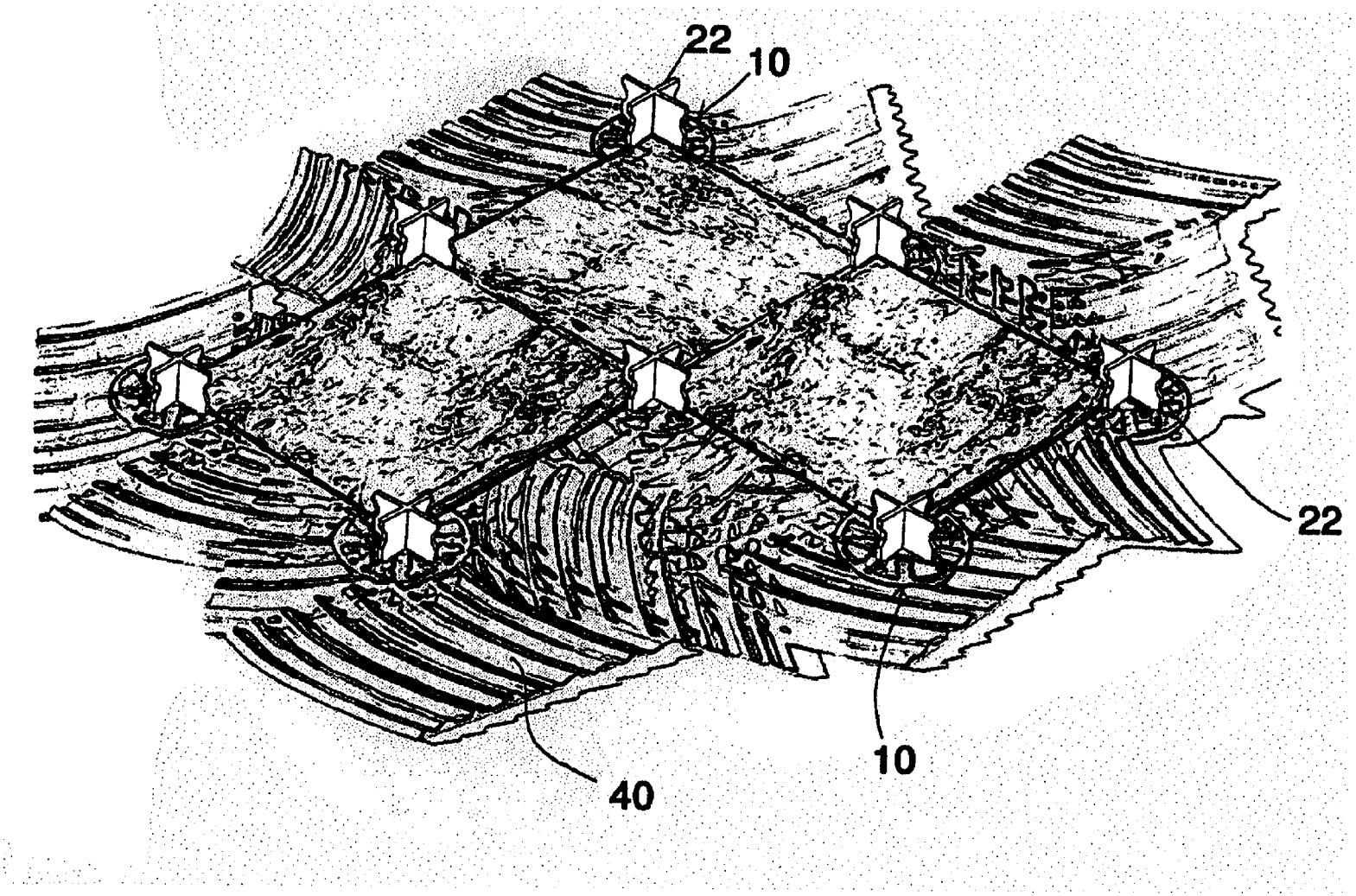
FIG. 9 is a top perspective view showing several tiles positioned on an adhesive bearing subfloor, where plural grout dividers have been placed to uniformly separate adjacent tiles for ultimately receiving a grouting mix.
Figure 10:
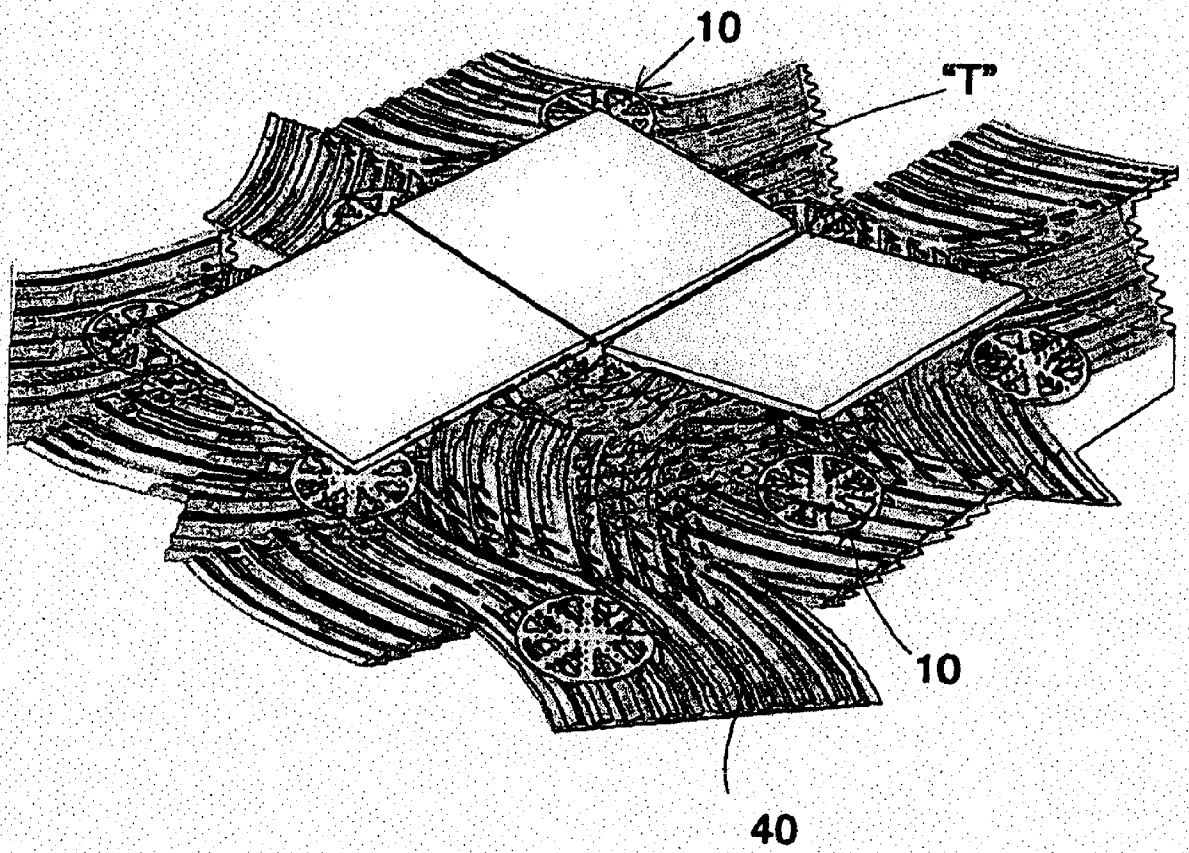
FIG. 10 is a top perspective view similar to FIG. 9, where the respective tiles have been placed side-by-side without the grout dividers according to the system of this invention.
Figure 12:
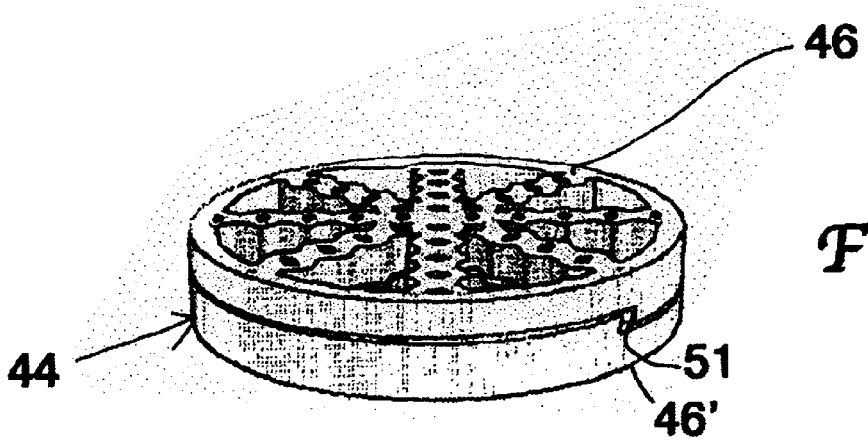
FIG. 12 is a perspective view of the assembled insert of FIG. 11, where the insert reveals a thin profile.
Figure 13:
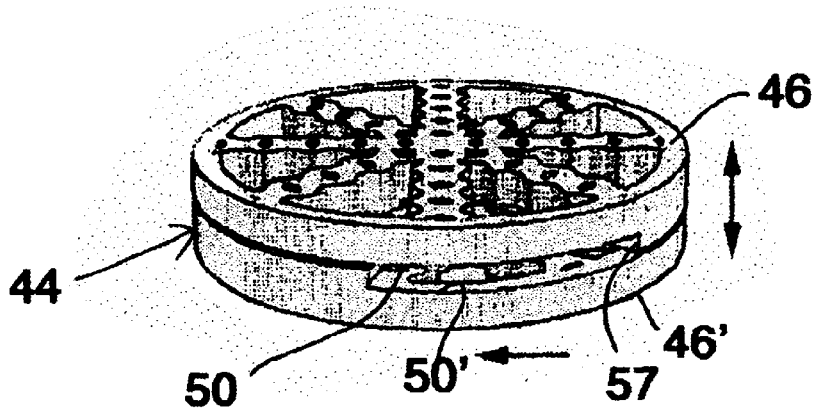
FIG. 13 is a perspective view of the assembled insert of FIG. 11, where the insert has been partially rotated to an intermediate profile.
Figure 14:
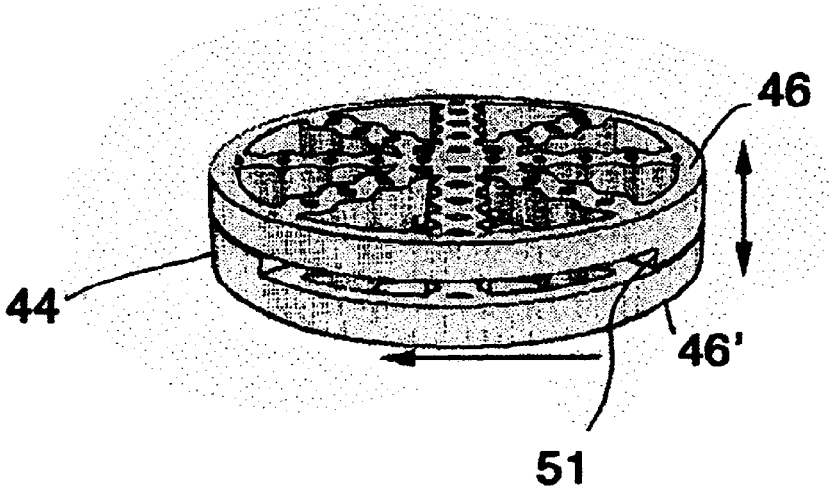
FIG. 14 is a perspective view, similar to FIGS. 12 and 13, showing the insert with a thicker profile.

FIGS. 9 and 10 are two perspective views, where FIG. 9 shows the adhesive layer 40 that has been spread and troweled, as known in the art, with plural inserts 10 positioned at stragetic locations within the adhesive layer 40. Within the inserts are the complementary space dividers 22. FIG. 10 shows a similar arrangement for a laid floor without the space dividers, or where no dividers have been used. In any case, the system of this invention, especially by the use of stragetically positioned inserts, whether internally of the floor or along the edges and corners, provides a convenient manner to laying and leveling a tile floor.

FIGS. 11–14 illustrate a further embodiment to the tile laying and leveling system of this invention. In some situations, particularly with uneven flooring substrates, it may be desirable to provide a system to adjust the relative height of the inserts to be placed at internal floor locations. The modified inserts 44 comprise a pair of disk-like components, comparable in construction to the inserts of FIGS. 1 and 2, but are characterized by a first planar face 46, 46' that is perpendicular to the peripheral wall 48, and an opposite planar face 50, 50' that is angled relative to the first planar faces, where the difference in the changing height is defined by the stop 51. The respective disk-like components forming the modified insert 44 are fixed for rotative movement relative to one another by center pin 52. In a first operative mode (FIG. 12) the respective disk-like components are contiguous to reflect the thinnest profile for the insert 44. However, as the respective are rotated relative to one another, the contiguous mating faces act like a cam and cam riding surface to separate the disk-like components and raise the height of the insert. For example, the thinnest profile would be at 0° while the greatest thickness would be a rotation of one disk-like comoponent at 180°. Thus, to control the height at intermediate levels, one would select a rotative turn somewhere in between.

It is recognized that variations, changes and modifications may be made to the system of this invention without departing from the spirit and scope thereof Accordingly, no limitation is intended to be imposed thereon except as set forth in the accompanying claims.

What is claimed is:

1. A method of laying and leveling a walking surface of tiles, where said tiles are rectangular in configuration and placed in a pattern of tiles generally in close proximity to one another on a substrate, said method comprising:

a.) spreading a quantity of tile adhesive over said substrate, b.) defining a grid to position the respective tiles, c.) embedding a plurality of inserts along the grid at positions which define at least one corner of a selected tile, said insert comprising a plastic member having upper and lower planar surfaces, plural radial vanes having a wavy side wall and a series of openings to allow said adhesive to enter said openings and around said vanes, where certain of said inserts are single members having a circular configuration to be overlaid by four said tiles, d.) providing a space divider removably inserted into said openings of said insert to provide spacings between adjacent said tiles, and e.) placing said tiles onto said inserts into close proximity to one another to provide a level said walking surface.

2. The method according to claim 1, where at least certain of said inserts are semi-circular in configuration to be overlaid by two said tiles.

3. The method according to claim 1, where at least certain of said inserts are quarter-circular in configuration to be overlaid by a single said tile.

4. The method according to claim 1, wherein said space divider includes a pair of intersecting walls and defined by a lower edge, where said edge includes at least a pair of tapered projections for removable insertion into said openings.

5. The method according to claim 4, wherein the height of said space divider is greater than the thickness of said tiles.

6. The method according to claim 1, wherein said insert is a pair of rotatively mounted disk members, where said members are circular in configuration having a vertical peripheral wall, a first face perpendicular thereto and a second face angled thereto.

7. The method according to claim 6, wherein said disk members are joined by a central pin member.

8. The method according to claim 7, wherein said angled faces are initially positioned adjacent to one another to define a thin profile, where rotation of one said disk member to the other said disk member will effect a separation of said disk members to define a thicker profile.

9. The method according to claim 8, wherein a rotation of from 0° to 180°, respectively, define said thin profile to a maximum thicker profile.

* * * * *